US006729344B1

(12) United States Patent
Hung

(10) Patent No.: US 6,729,344 B1
(45) Date of Patent: May 4, 2004

(54) FAUCET FOR A COLD/HOT FOUNTAIN WATER MACHINE

(75) Inventor: Jerry Hung, Changhua (TW)

(73) Assignee: Shion Choin Industrial Co., Ltd., Changhua (TW)

( * ) Notice: Subject to any disclaimer, the term of this patent is extended or adjusted under 35 U.S.C. 154(b) by 24 days.

(21) Appl. No.: 10/277,753

(22) Filed: Oct. 23, 2002

(51) Int. Cl.[7] ..... E03C 1/04

(52) U.S. Cl. ..... 137/339; 4/678; 137/801; 222/146.2

(58) Field of Search ..... 4/678; 137/339, 137/801; 222/146.2

(56) References Cited

U.S. PATENT DOCUMENTS 4,077,545 A * 3/1978 Karls ..... 137/801
5,417,348 A * 5/1995 Perrin et al. ..... 137/801

* cited by examiner

*Primary Examiner*—Gerald A. Michalsky
(74) *Attorney, Agent, or Firm*—Troxell Law Office PLLC

(57) ABSTRACT

A faucet for a cold/hot fountain water machine has a mounting base, a cover, a positioning tube, a hot water delivery tube, and an external tube wherein the mounting base is equipped with a pair of cold and hot water controlling handles bifurcating at both sides thereof for regulating the discharge of cold/hot water. The cover is sleeve joined to the external tube and securely located thereto via a C-shaped hook. The external tube is sleeve joined to the upper section of the hot water delivery tube thereof with the hot water delivery tube thereof housed therein and a fissure pipe line defined thereby for the discharge of cold water. The mounting base also has a recycle tube for sending cold water taken in via a diverted line of a water inlet tube thereof to a heater connected to one end of the hot water delivery tube for the discharge of hot water. Via the constant recycle of cold/hot water, the mounting base is guarded from the danger of high temperature when hot water is discharged for a long time; moreover, the fissure pipe line can also insulate the heat transfer of the hot water delivery tube and lower the temperature of the external tube to effect further security thereof.

1 Claim, 5 Drawing Sheets

FAUCET FOR A COLD/HOT FOUNTAIN WATER MACHINE

BACKGROUND OF THE INVENTION

The present invention is related to a faucet for a cold/hot fountain water machine, comprising a mounting base, a cover, a positioning tube, a hot water tube and an external tube wherein said external tube is sleeve joined to the upper section of said hot water delivery tube with a fissure pipe line defined therein for the discharge of cold water. Said mounting base has a recycle tube for sending cold water taken in via a diverted line of a water inlet tube thereof to a heater connected to one end of said hot water delivery tube for the discharge of hot water. Via the constant recycle of cold/hot water, said mounting base is guarded from the danger of high temperature when hot water is discharged for a long time; moreover, said fissure pipe line can also insulate the heat transfer thereof to effect further security.

Please refer to FIG. 1. A conventional faucet for a cold/hot fountain water machine 10 is mainly made up of a mounting base 11, a pair of cold and hot water intake pipes 12, 13 connected to the bottom of said mounting base 11, and a pair of handle set 14 with a pair of ball valves 141 disposed therein to regulate the discharge of cold/hot water. A water outlet pipe 15 is disposed at the top of said mounting base 11 thereof for the discharge of cold/hot water. One end of said hot water intake pipe 13 is linked a heater 16 which has a cold water inlet tube 17 attached thereto at the bottom to take in cold water for heating up. The hot water is then sent to said ball valve 141 via said hot water intake pipe 13 and discharged directly via said water outlet pipe is thereof.

There are some drawbacks to such conventional faucet for cold/hot fountain water machine. Most of all, due to heat transfer, said mounting base 11 and said water outlet pipe 15 are high in temperature when hot water is discharged for a long time, causing the danger of burning to the users.

SUMMARY OF THE PRESENT INVENTION

It is, therefore, the primary purpose of the present invention to provide a faucet for a cold/hot fountain water machine wherein, for the discharge of hot water, cold water taken in via a water inlet tube of a mounting base is sent to a recycle tube of said mounting base thereof via a diverted line. Said recycle tube sends the intake cold water to a heater from which hot water is discharged directly via a hot water delivery tube. Via the constant recycle of cold/hot water, said mounting base is protected from the danger of high temperature when hot water is discharged for a long period of time.

It is, therefore, the second purpose of the present invention to provide a faucet for a cold/hot fountain water machine wherein an external tube is sleeve joined to the upper section of said hot water delivery tube with a fissure pipe line defined therein for the discharge of cold water. Said fissure pipe line can also insulate the heat transfer of said hot water delivery tube thereof and cut down the temperature of said external tube to effect further protection thereof.

BRIEF DECRIPTION OF THE DRAWINGS

DETAILED DESCRIPTION OF THE PREFERRED EMBODIMENTS

Figure 1:
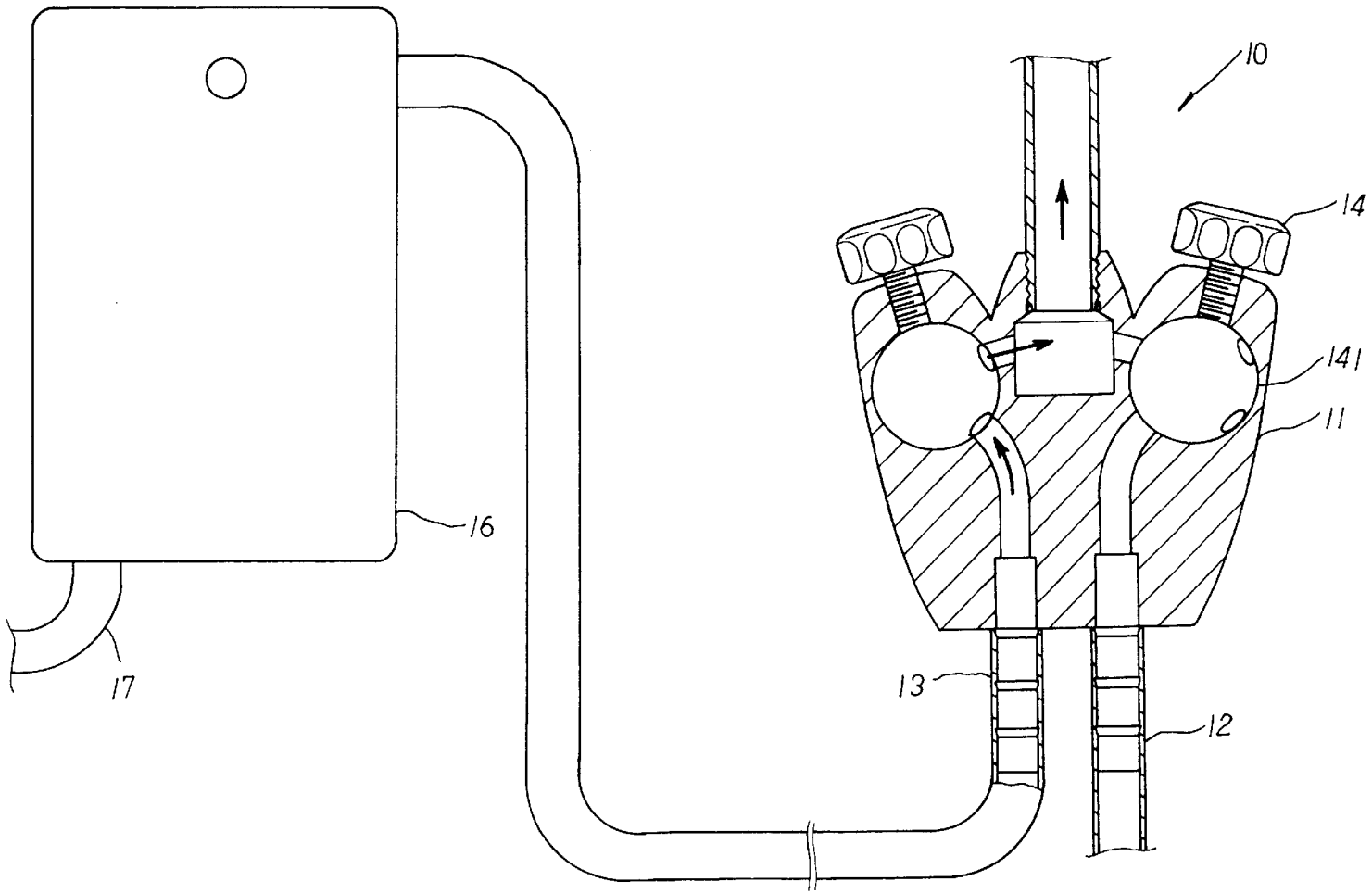
FIG. 1 PRIOR ART
FIG. 1 is a perspective view of a conventional faucet for a cold/hot fountain water machine in assembly.
Figure 2:
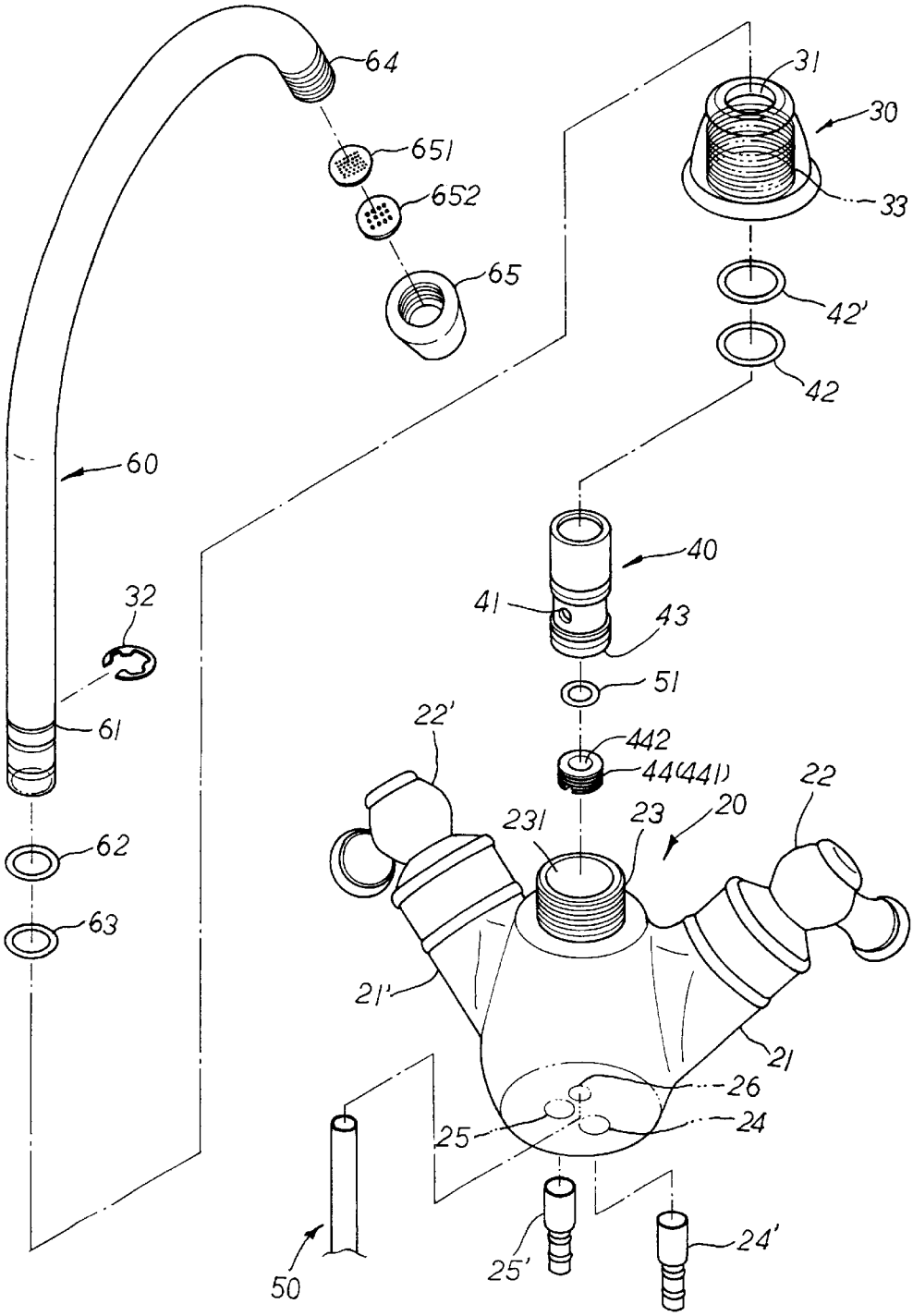
FIG. 2 is a perspective exploded view of the present invention.

Please refer to FIG. 2. The present invention is related to a faucet for a cold/hot fountain water machine, comprising a mounting base 20, a cover 30, a positioning tube 40, a hot water delivery tube 50, and an external tube 60.

Figure 5:
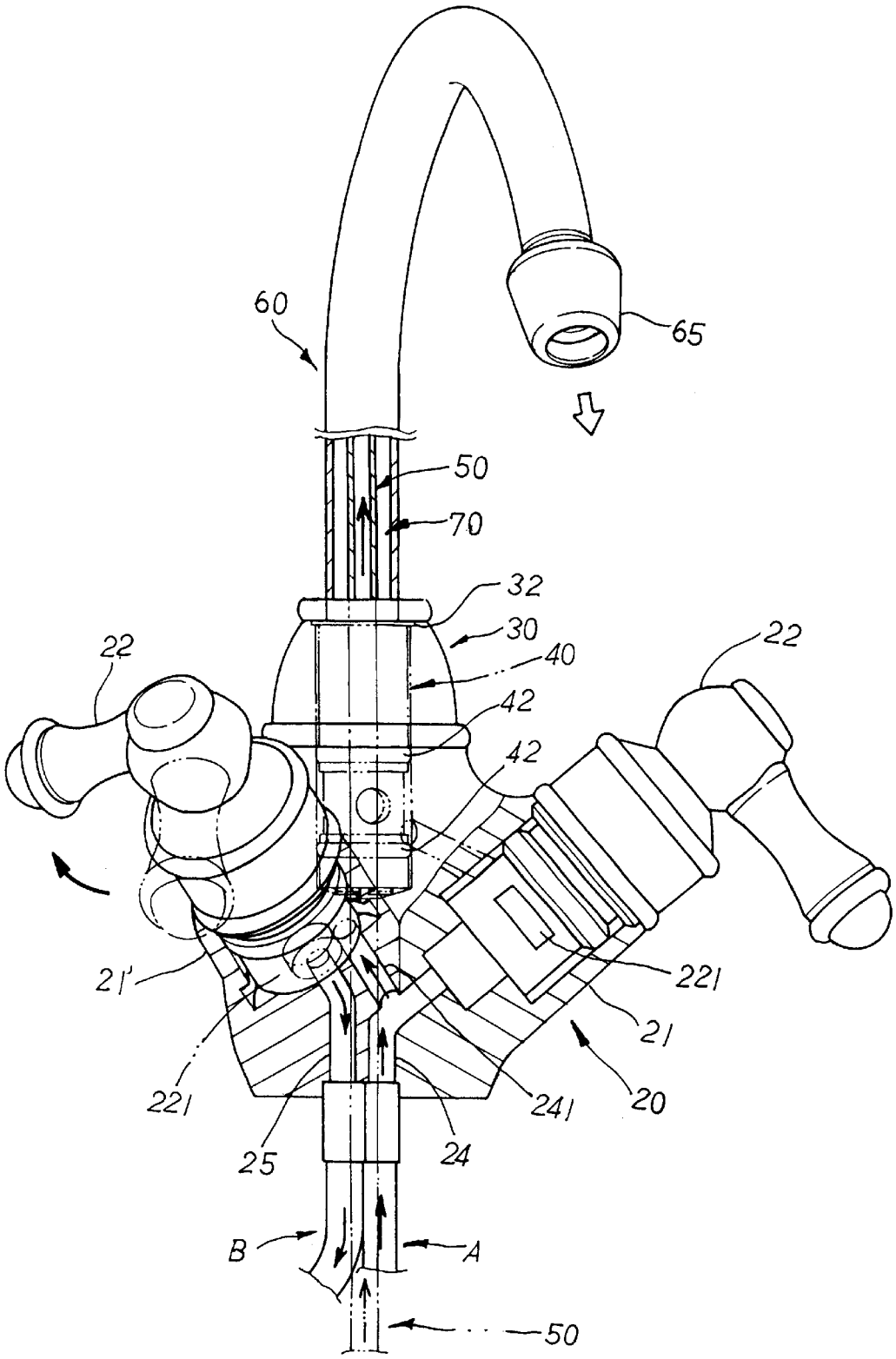
FIG. 5 is diagram showing the discharge of hot water of the present invention in use.

Said mounting base 20 is equipped with a pair of right and left handle seats 21, 21' bifurcating at both sides thereof for a pair of cold and hot water controlling handles 22, 22' to be adapted thereto respectively, an externally threaded end 23 of smaller diameter projecting at the top thereof with a water outlet 231 disposed at the center thereof, and a water inlet tube 24 and a recycle tube 25 disposed at the inside of the lower section thereof and led down to the bottom thereof for a pair of connecting heads 24',25' to be attached thereto respectively. A diverted line 241 is disposed at the upper section of said water inlet tube 24 thereof as shown in FIG. 5, communicating with said left handle seat 21' thereof and, along with said recycle tube 25, regulated by said hot water control handle 22' thereof. A hot water tube 26 is disposed properly at the lower section of said base mount 20 thereof, communicating with said water outlet 231 at the top thereof and led down to the bottom thereof for said hot water delivery tube 50 thereof with a water-stop ring 51 disposed thereon to be led and sleeve joined therewith. Said cover 30 is provided with a central through hole 31 disposed at the top thereof for said external tube 60 to be located thereto via a C-shaped hook 32, and an internally threaded section 33 disposed at the lower side thereof. Said positioning tube 40 is a hollow tube, having a water inlet hole 41 symmetrically disposed at a proper position thereon and defined by a pair of upper and lower sealing rings 42, 42' disposed at both upper and lower sides thereof. Said positioning tube 40 also has an internally threaded end 43 disposed at the lower section thereof to be screw joined to an outer threaded section 441 of a retaining block 44 with a slot 442 disposed at the center thereof.

Said hot water delivery tube 50 is a heat resistant soft plastic tube with an outer diameter smaller than the inner diameter of said external tube 60 so as to be led and housed at said external tube 60 therein. Said external tube 60 is provided with a ring groove 61, and a pair of sealing washers 62, 63, properly disposed at the lower end thereof, and an externally threaded upper end 64 for a filter nozzle 65 with two filter gauzes 651, 652 to be securely fixed thereto.

Figure 3:
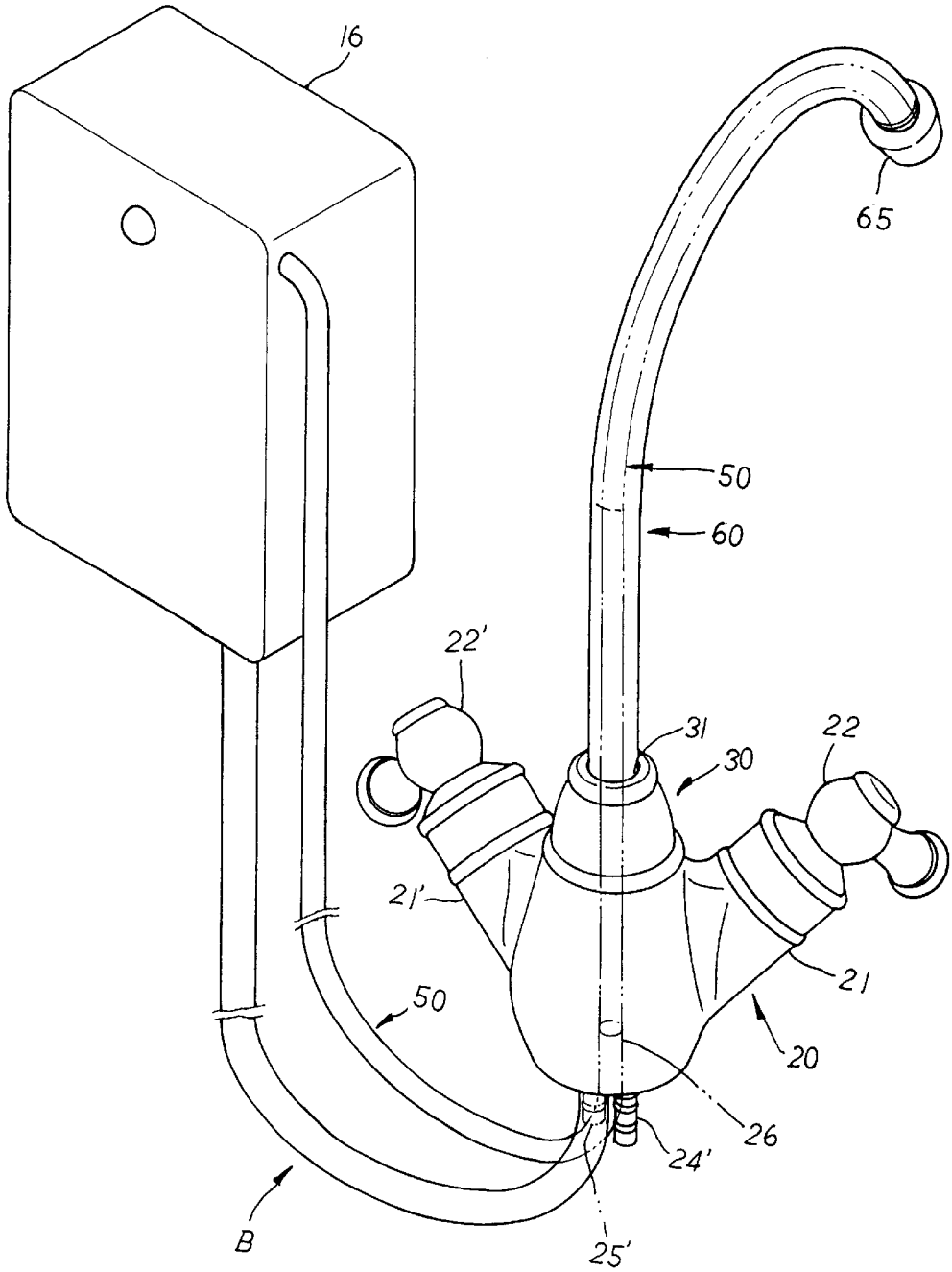
FIG. 3 is a perspective view of the present invention in assembly.

Please refer to FIG. 3. In assembly, said external tube 60 is led downwards and sleeve joined to the upper section of said hot water delivery tube 50 thereof with said hot water delivery tube 50 thereof housed therein and a fissure pipe line 70 defined thereby for the discharge of cold water. Said cover 30 is then led from the lower end of said hot water delivery tube 50 thereof via said central through hole 31 thereof to be sleeve joined to the lower end of said external tube 60 and located thereto via said C-shaped hook 32 adapted to the ring groove 61 of said external tube 60 thereof. The lower end of said hot water delivery tube 50 is led through said positioning tube 40 and the slot 442 of said retaining block 44 till said water-stop ring 51 abutting against the top side of said retaining block 44 thereof. Said hot water delivery tube 50 is then sequentially led through the water outlet 231 and the hot water tube 26 of said mounting base 23 to come out at the bottom of said mounting base 23 thereof and connect to a heater 16 at the other end thereof. Said positioning tube 40 is housed at said mounting base 23 therein, and said internally threaded section 33 of said cover 30 is screw joined to the externally threaded end 23 of said mounting base 20 for secure engagement thereof. Two water inlet pipes A, B are engaged with said connecting heads 24', 25' at one end respectively wherein said water inlet pipe B is joined to said heater 16 at the other end thereof to complete the assembly thereof.

Figure 4:
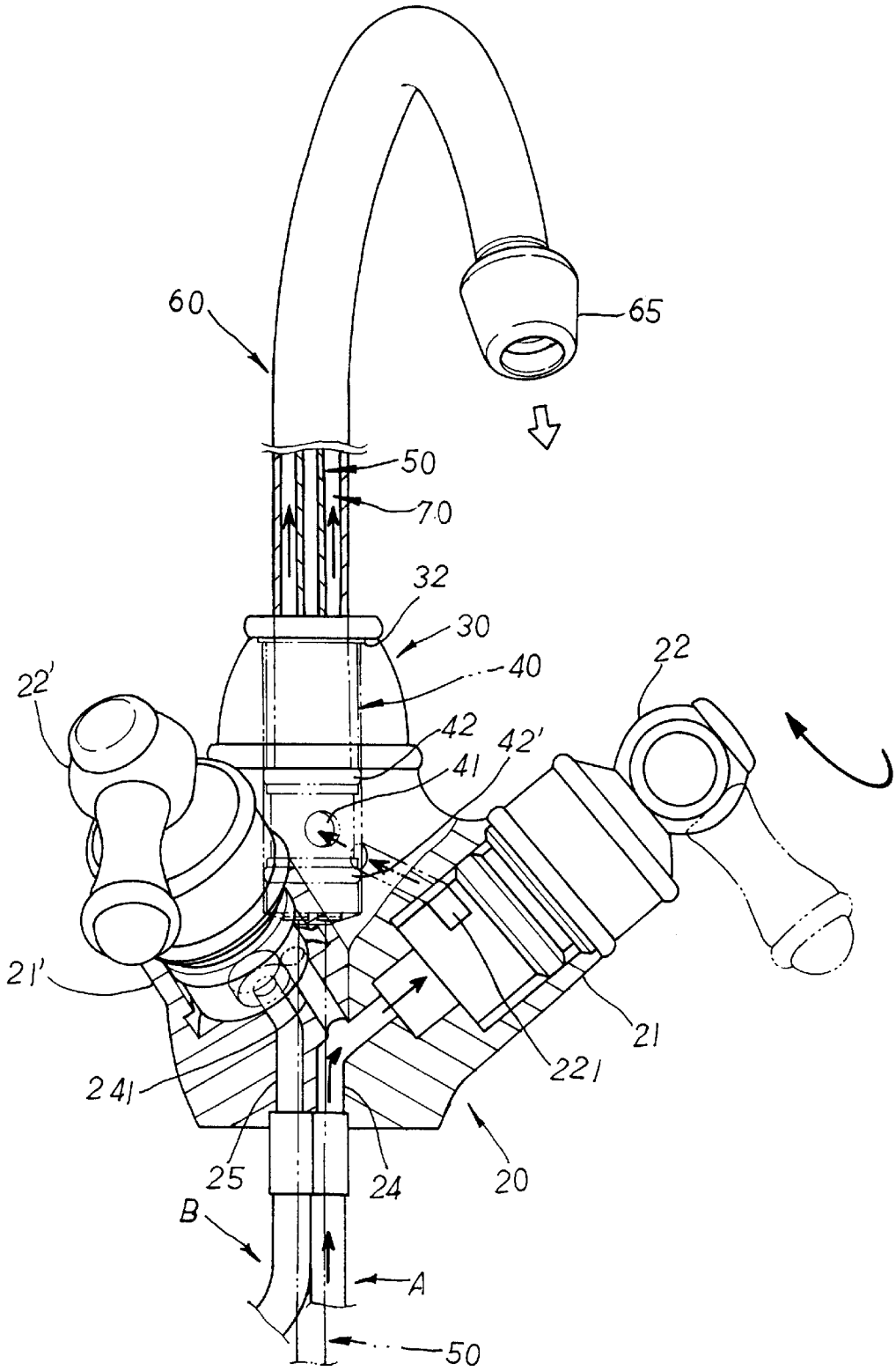
FIG. 4 is a diagram showing the discharge of cold water of the present invention in use.

Please refer to FIG. 4. For the discharge of cold water in operation, said cold water controlling handle 22 is rotated for cold water to come out of said water inlet pipe A and flow into a water outlet groove 221 of said cold water controlling handle 22 thereof via said water inlet tube 24 linked to said connecting head 24' thereof. Said inlet cold water will then flow into said positioning tube 40 via said water inlet 41 thereof wherein said upper and lower sealing rings 42, 42' will stop the intake cold water from leaking into said mounting base 20 thereof. Finally, said cold water is discharged out of said filter nozzle 65 via said fissure pipe line 70 thereof defined by said hot water delivery tube 50 and said external tube 60 thereof.

Please refer to FIG. 5. For the discharge of hot water in operation, said hot water controlling handle 22' is activated for cold water to come out of said water inlet pipe A thereof and flow into a water-collecting zone 221' of said hot water controlling handle 22' thereof via said diverted line 241 of said water inlet tube 24 thereof. Said recycle tube 25 will send the collected cold water back to said heater 16 via said water inlet pipe B attached to said connecting head 25' thereof for heating-up thereof. The hot water sent out of said heater 16 is directly discharged out of said filter nozzle 65 via said hot water delivery tube 50 thereof. Thus, via the constant recycle of cold/hot water, said mounting base is guarded from the danger of high temperature when hot water is discharged for a long time; moreover, said fissure pipe line thereof can also insulate the heat transfer of said hot water delivery tube and cut down the temperature of said external tube to effect further security thereof.

What is claimed is:

1. A faucet for a cold/hot fountain water machine, comprising a mounting base, a cover, a positioning tube, a hot water delivery tube, and an external tube wherein said mounting base is equipped with a pair of right and left handle seats bifurcating at both sides thereof for a pair of cold and hot water controlling handles to be adapted thereto respectively, and an externally threaded top end with a water outlet disposed at center thereof to be screw joined to an internally threaded section of said cover thereof, and said cover has a central through hole to be sleeve joined to said external tube and securely located thereto via a C-shaped hook; said present invention is characterized by that, said mounting base also including a water inlet tube and a recycle tube disposed at the inside of the lower section thereof and led to the bottom thereof for a pair of connecting heads to be attached thereto respectively wherein said water inlet tube having a diverted line disposed at the upper section thereof which communicates with said left handle seat thereof and, along with said recycle tube, is regulated by said hot water control handle thereof; a hot water tube being disposed properly at the lower section of said base mount thereof, communicating with said water outlet at the top and led down to the bottom thereof for said hot water delivery tube thereof with a water-stop ring disposed thereon to be led and sleeve joined therewith;

said positioning tube, a hollow tube, having a water inlet hole symmetrically disposed at a proper position thereon, a pair of upper and lower sealing rings defining properly at both upper and lower sides of said water inlet hole thereof, and an internally threaded lower end to be screw joined to an outer threaded section of a retaining block;

said retaining block having a slot disposed at the center thereof for said hot water delivery tube to be led there-through and come out of said positioning tube at the other end thereof;

said hot water delivery tube being a heat resistant soft plastic tube with an outer diameter smaller than the inner diameter of said external tube so as to be led and housed at said external tube therein;

said external tube having a ring groove for said C-shaped hook to be located thereto and a pair of sealing washers properly disposed at the lower end thereof, and an externally threaded upper end thereof for a filter nozzle with two filter gauzes to be securely fixed thereto;

in assembly, said external tube is sleeve joined to the upper section of said hot water delivery tube thereof with said hot water delivery tube thereof housed therein and a fissure pipe line defined thereby for the discharge of cold water, and the lower section of said hot water delivery tube coming out at the bottom of said mounting base thereof is connected to a heater to which a water inlet pipe B is attached; said recycle tube thereof is linked to said water inlet pipe via said connecting head thereof, forming a return passage for the discharge of hot water;

for the discharge of cold water in operation, said cold water controlling handle is rotated for cold water to come out of a water inlet pipe A and flow into a water outlet groove of said cold water controlling handle thereof via said water inlet tube thereof; said intake cold water then flows into said positioning tube via said water inlet thereof wherein said upper and lower sealing rings will stop said intake cold water from leaking into said mounting base thereof for said cold water to be discharged out of said filter nozzle via said fissure pipe line thereof defined by said hot water delivery tube and said external tube thereof; for the discharge of hot water, said hot water controlling handle is activated for cold water to come out of said water inlet pipe A thereof and flow into a water-collecting zone of said hot water controlling handle via said diverted line thereof; said recycle tube then sends the collected cold water to said heater via said water inlet pipe B for the heating-up thereof; said hot water sent out of said heater is directly discharged out of said filter nozzle via said hot water delivery tube thereof;

whereby, via the constant recycle of cold/hot water, said mounting base is guarded from the danger of high temperature when hot water is discharged for a long period of time; moreover, said fissure pipe line can also insulate the heat transfer of said hot water delivery tube and cut down the temperature of said external tube so as to avoid burning the users and effect further protection thereof.

* * * * *